US007104362B2

(12) United States Patent
Meeker

(10) Patent No.: US 7,104,362 B2
(45) Date of Patent: Sep. 12, 2006

(54) FOLDABLE STEP LADDER WITH LEG ALIGNER AND HANDLE

(75) Inventor: Paul K. Meeker, Hiram, OH (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 10/649,026

(22) Filed: Aug. 27, 2003

(65) Prior Publication Data

US 2005/0045423 A1 Mar. 3, 2005

(51) Int. Cl.
*G06C 1/00* (2006.01)

(52) U.S. Cl. ..... 182/165; 182/161

(58) Field of Classification Search ..... 182/165, 182/161, 129, 22
See application file for complete search history.

(56) References Cited

U.S. PATENT DOCUMENTS

| | | | | |
|---|---|---|---|---|
| 1,557,490 | A | 10/1925 | Videtta | |
| 1,817,233 | A | 8/1931 | Bumgardner | |
| 2,776,856 | A | 1/1957 | Ingram | |
| 2,873,995 | A | 2/1959 | Turner | |
| 2,908,362 | A | 10/1959 | Burtchaell | |
| 2,967,730 | A | 1/1961 | Vann | |
| 2,997,326 | A | 8/1961 | Daum | |
| 3,718,242 | A | 2/1973 | Larson | |
| 3,892,343 | A | 7/1975 | Warner | |
| 4,448,282 | A * | 5/1984 | Giezendanner | 182/22 |
| 4,483,415 | A | 11/1984 | Disston et al. | |
| 4,485,892 | A | 12/1984 | Maloney et al. | |
| 4,707,883 | A | 11/1987 | Irani et al. | |
| 4,733,882 | A | 3/1988 | Kassai | |
| 4,842,315 | A | 6/1989 | Nordmeyer | |
| 5,158,151 | A | 10/1992 | Chang | |
| 5,161,843 | A | 11/1992 | Baldwin | |
| 5,170,862 | A | 12/1992 | Chang | |
| 5,210,904 | A | 5/1993 | Pratt | |
| 5,232,796 | A | 8/1993 | Baumgartner | |
| 5,511,285 | A * | 4/1996 | Bush et al. | 16/422 |
| 5,762,163 | A | 6/1998 | Kain | |
| 5,823,564 | A | 10/1998 | Kettler | |
| 5,937,968 | A * | 8/1999 | Gibson et al. | 182/165 |
| 5,979,928 | A | 11/1999 | Kuo | |
| 5,992,567 | A | 11/1999 | Chiu | |
| 6,000,497 | A | 12/1999 | Kain et al. | |
| 6,026,933 | A | 2/2000 | King et al. | |
| 6,039,149 | A | 3/2000 | Bedja et al. | |
| 6,062,587 | A | 5/2000 | Cabagnero | |
| 6,073,945 | A | 6/2000 | Cheng | |
| 6,073,957 | A | 6/2000 | Lan | |
| 6,155,740 | A | 12/2000 | Hartenstine | |

(Continued)

*Primary Examiner*—Alvin Chin-Shue
(74) *Attorney, Agent, or Firm*—Barnes & Thornburg LLP

(57) ABSTRACT

A step ladder includes a frame having a front leg and a rear leg coupled to the front leg for movement relative to the front leg between an opened position and a collapsed position. A pivot support mount of the step ladder supports a handle of the step ladder for pivotable movement on the front leg about a pivot axis. The step ladder further includes a retainer member coupled to the handle to move therewith about the pivot axis. The retainer member is arranged to lock the front leg to the rear leg when the front and rear legs are in the collapsed position. A guide of the step ladder is coupled to the pivot support mount and configured to engage the rear leg and maintain the rear leg in alignment with the front leg when the frame is in the collapsed position.

5 Claims, 5 Drawing Sheets

U.S. PATENT DOCUMENTS 6,390,238 B1 * 5/2002 Gibson et al. ..... 182/161

6,454,050 B1 9/2002 Gibson et al.

* cited by examiner

FOLDABLE STEP LADDER WITH LEG ALIGNER AND HANDLE

BACKGROUND

The present disclosure relates to a ladder, and particularly to a collapsible ladder. More particularly, the present disclosure relates to a collapsible ladder including a carrying handle for use when the ladder has been folded to assume a collapsed, storage position.

Ladders have a frame and one or more steps that people use for elevation when reacting for objects, painting walls or any everyday task where extra elevation would be helpful. Ladders are often foldable for ease of storage when the ladder is not being used.

SUMMARY

According to the present disclosure, a step ladder includes a frame including a front leg and a rear leg coupled to the front leg for movement relative to the front leg between an opened position and a collapsed position. The step ladder also includes a carrier lock coupled to the front and rear legs of the step ladder to align and lock the front and rear legs when the frame is in the collapsed position. The carrier lock includes handle and a pivot support mount configured to support the handle for pivotable movement on the front leg about a pivot axis. An alignment bracket is coupled to the rear leg and cooperates with the pivot support mount and handle to align and lock the front and rear legs to each other.

A retainer member is coupled to the handle to move with the handle about the pivot axis to trap a portion of the bracket between the pivot support mount and the retainer member upon movement of the handle to a predetermined position relative to the rear leg to lock the front leg to the rear leg when the front and rear legs are in the collapsed position. An alignment guide is coupled to the pivot support mount to engage the rear leg and maintain the rear leg in alignment with the front leg when the frame is in the collapsed position. Similarly, an alignment tab of the bracket provided to engage the front leg and maintain the front leg in alignment with the rear leg when the frame is in the collapsed position.

Features of the present disclosure will become apparent to those skilled in the art upon consideration of the following detailed description of preferred embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
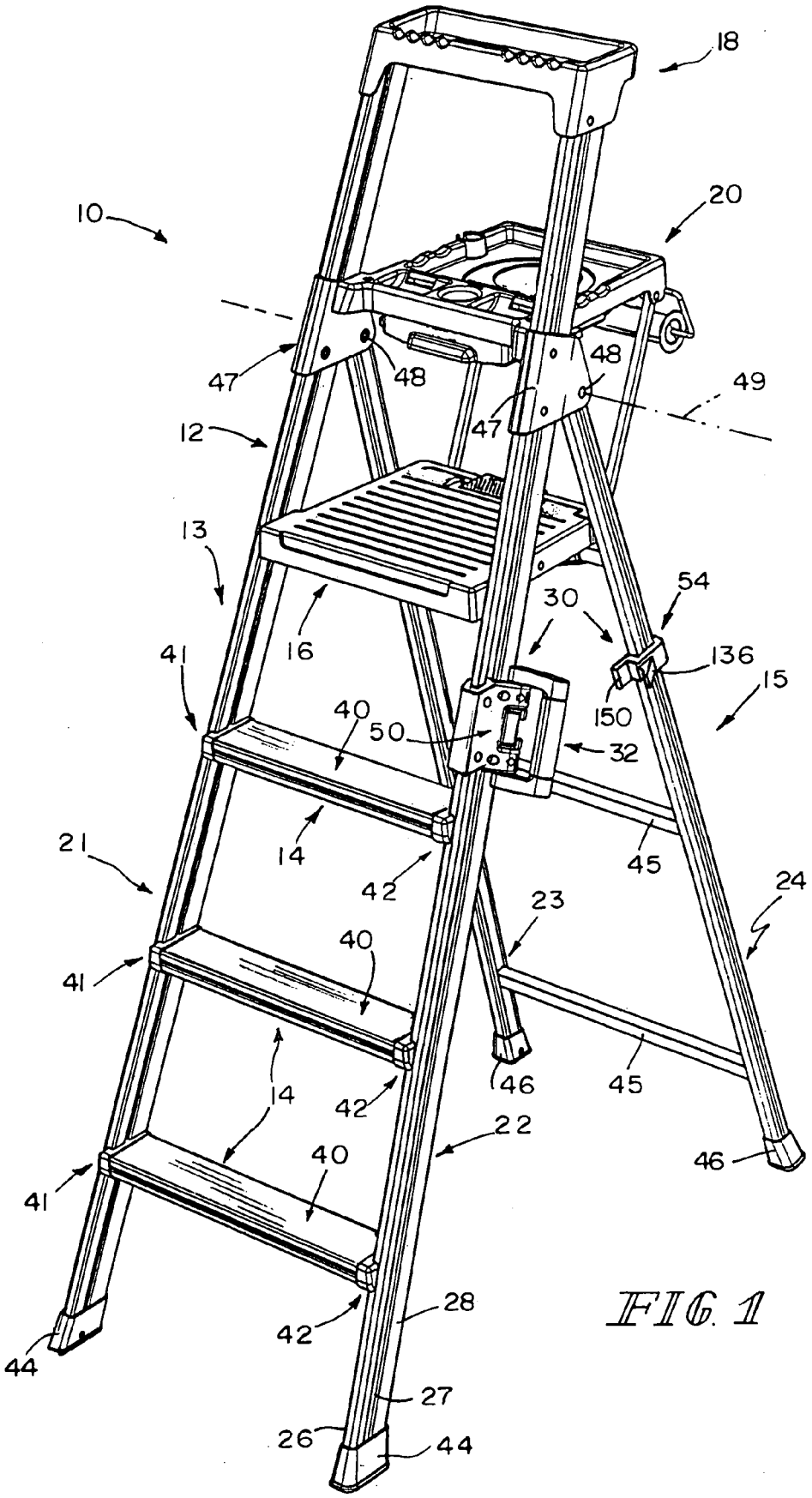
FIG. 1 is a perspective view of a step ladder in accordance with the present disclosure in an opened position showing an inclined front frame comprising left and right legs, three hollow step units coupled to the left and right legs of the inclined front frame, and an inclined rear frame comprising smaller left and right legs, and further showing a carrier lock having a pivot support mount and handle coupled to the right leg of the front frame and an alignment bracket coupled to a corresponding right leg of the rear frame.
Figure 4:
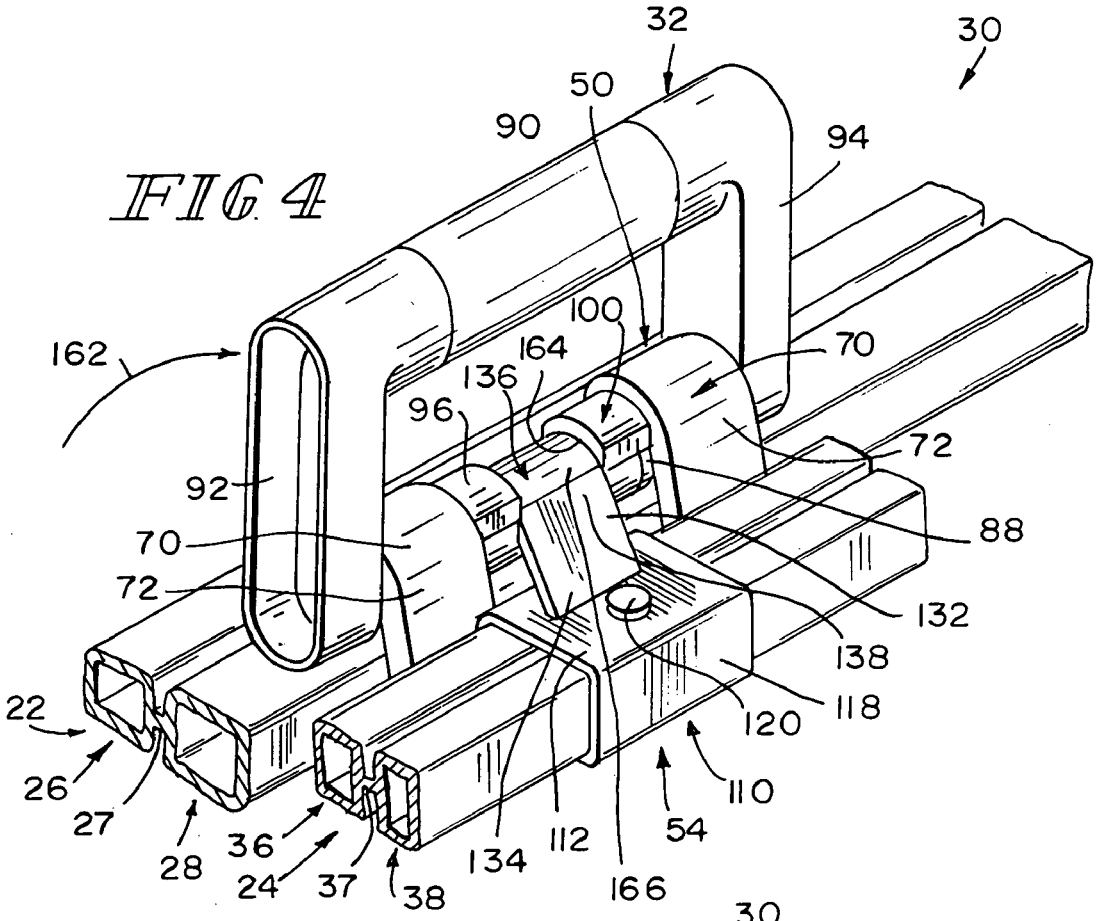
FIG. 4 is a perspective view similar to FIGS. 2 and 3 showing the handle of the carrier lock in a locked and ready-to-carry position and the retainer members of the handle engaged with a portion of the alignment bracket to retain the alignment bracket in the locked position.
Figure 5:
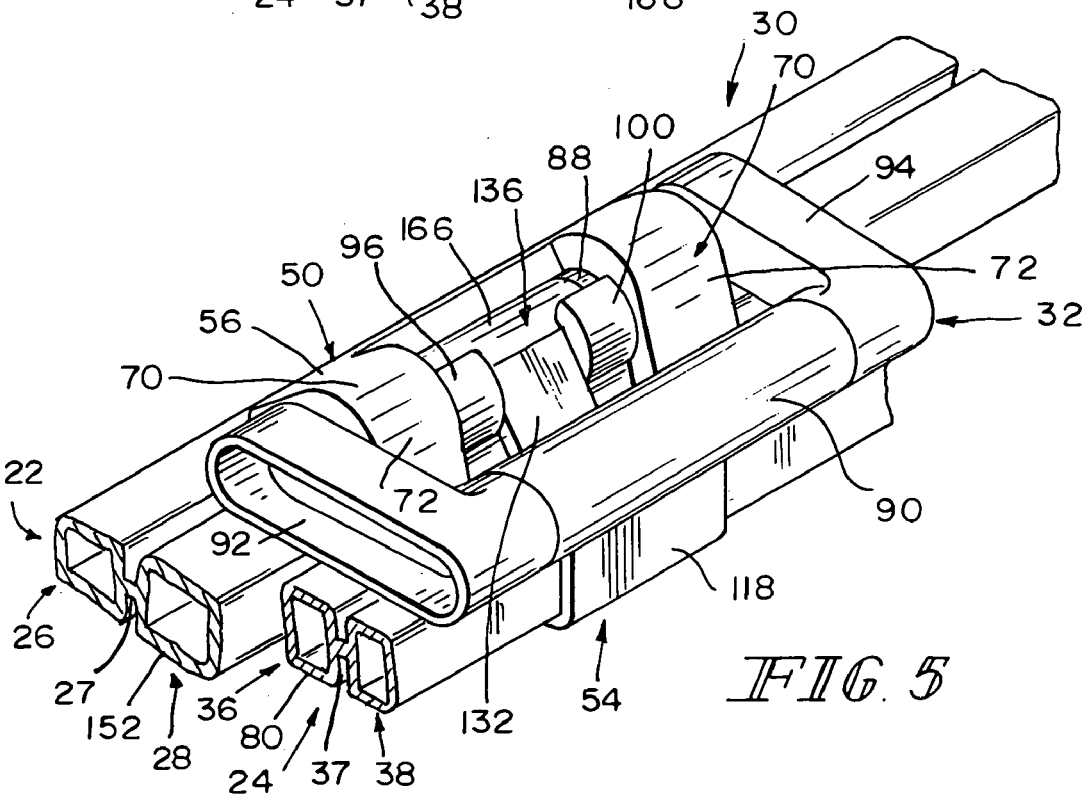
FIG. 5 is a perspective view similar to FIGS. 2–4 showing the handle of the carrier lock in the locked and stowed position where a gripping portion of the handle is positioned adjacent the rear leg.
Figure 8:
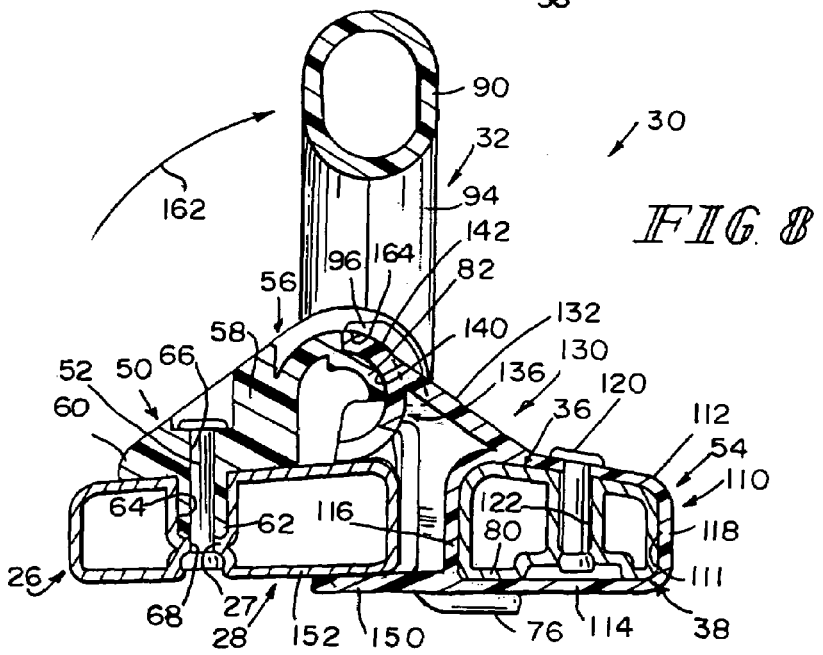
FIG. 8 is a sectional view similar to FIGS. 6 and 7 showing the handle moved to the ready-to-carry and locked position (as shown in FIG. 4) to be gripped by a user to conveniently carry the step ladder of the present disclosure.

As shown in FIG. 1, step ladder 10 includes a frame 12, several step units 14 mounted on the frame 12, a top platform step 16, a fixed tray 18, and a movable tray 20 located between the top platform step 16 and fixed tray 18. Frame 12 includes a front set 13 of left and right legs 21, 22 and a rear set 15 of left and right legs 23, 24. Step ladder 10 further includes a carrier lock 30 coupled to front and rear right legs 22, 24, as shown in FIG. 1, to provide means for aligning and locking legs 22, 24 upon movement of legs 22, 24 to a side-by-side collapsed position, as shown in FIGS. 4, 5, and 8. An alignment bracket 54 of carrier lock 30 coupled to right rear leg 24 as well as alignment guides 70 of carrier lock 30 coupled to right front leg 22 cooperate to align front and rear set 13, 15 of legs as the ladder 10 is moved to the collapsed position. A carrying handle 32 of carrier lock 30 allows a user to carry the collapsed and locked ladder 10.

As shown in FIGS. 2–8, front leg 22 includes first and second tubular members 26, 28 and a web 27 located between and coupled to first and second tubular members 26, 28 so as to rigidify front leg 22. Although not shown in the figures, front leg 21 includes the same or similar features of front leg 22. Also, each rear leg 23 and 24 includes third and fourth tubular members 36, 38 and a web 37 located between and coupled to third and fourth tubular members 36, 38 to rigidify rear legs 23, 24.

Each of step units 14 includes a step 40 and a pair of step mounts 41, 42, as shown in FIG. 1. Each of step mounts 41, 42 is configured to mate with one end of a respective step 40 and first and second tubular members 26, 28 of the leg 21 or 22 associated with the step mount. Fasteners (not shown) are used to anchor each step mount 41, 42 to one of the legs 21 or 22 to support the step 40 mated with the step mounts 41, 42 in a horizontally extending fixed position between left and right legs 21, 22.

As further shown in FIG. 1, frame 12 includes front frame portion 13 and rear frame portion 15 mounted for movement relative to front frame portion 13 between an expanded or use position (shown in FIG. 1) where front and rear frame portions 13, 15 are supported in an inclined position and a collapsed or storage position (shown with portions broken away in FIGS. 4 and 5) where front and rear frame portions 13,15 lie alongside each other. Front frame portion 13 includes left and right legs 21, 22 and leg end caps 44. Rear frame portion 15 includes left and right legs 23, 24, stretcher bars 45 interconnecting rear left and right legs 23, 24 and leg end caps 46. Rear frame portion 15 further includes pivot mounts 47 anchored in fixed positions on front left and right legs 21, 22 and coupled by means of pivot pins 48 to upper ends of rear left and right legs 23, 24 to support rear frame portion 15 for pivotable movement about a pivot axis 49 relative to front frame portion 13. A similar illustrative step ladder is shown and described in commonly-assigned U.S. patent application Ser. No. 10/443,373, titled RIGIDIFIED STEP LADDER, filed on May 23, 2003. This application is hereby incorporated by reference herein.

Figure 3:
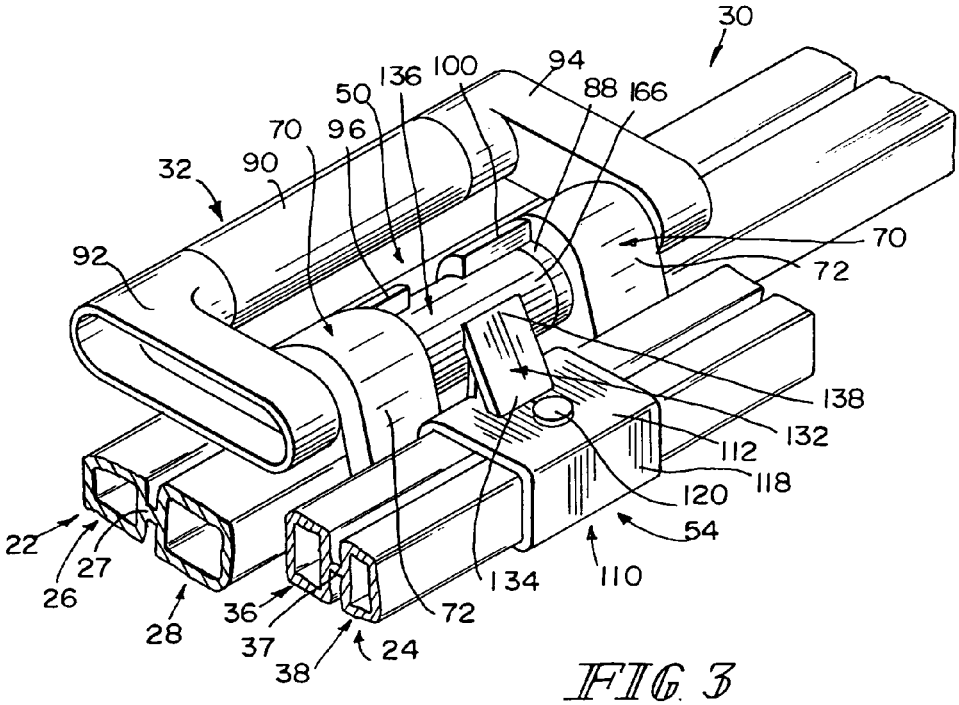
FIG. 3 is a perspective view similar to FIG. 2 showing the front leg and rear leg of the step ladder adjacent each other in a collapsed position so that the anchor member of the alignment bracket engages a portion of the pivot support mount and further showing the handle in an unlocked position.
Figure 6:
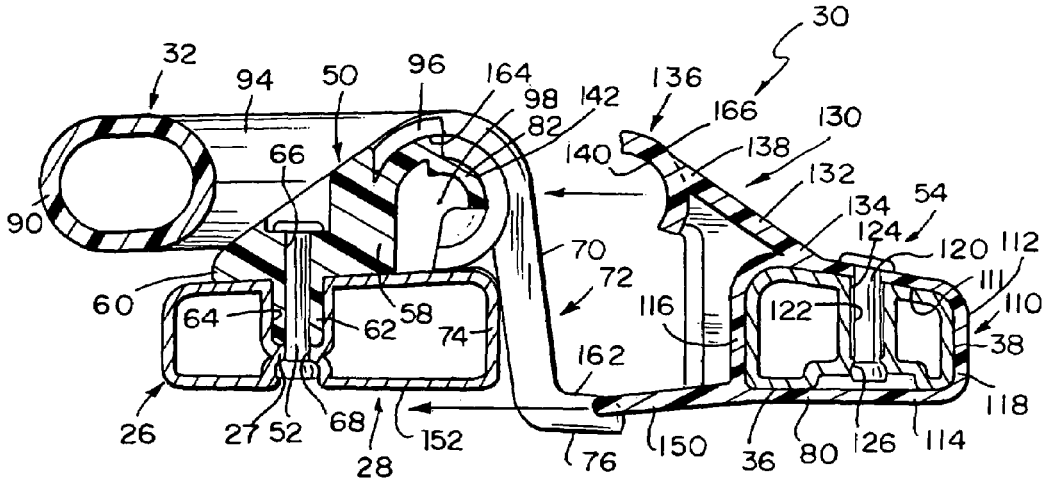
FIG. 6 is a sectional view taken along line 6—6 of FIG. 2 showing a base of the pivot support mount coupled to the front leg of the step ladder and alignment guides of the pivot support mount coupled to the base, and further showing the alignment bracket including a base formed to receive the rear leg therethough and showing an anchor mount and an alignment tab coupled to the base.
Figure 7:
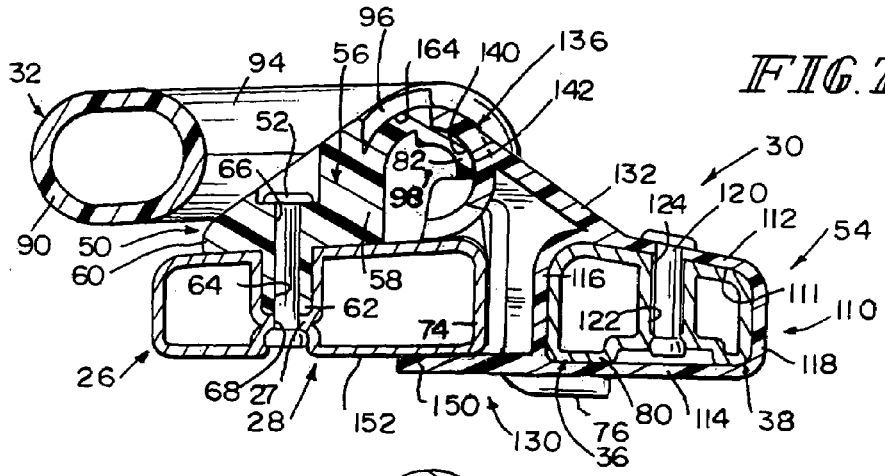
FIG. 7 is a sectional view similar to FIG. 6 showing the handle of the carrier lock in the unlocked position and showing the alignment bracket adjacent the pivot support mount (as shown in FIG. 3) so that the alignment tab of the alignment bracket lies adjacent the front leg of the step ladder and the anchor mount of the alignment bracket engages a central shaft of the pivot support mount.

As mentioned above, carrier lock 30 is coupled to front and rear right legs 22, 24 in the manner suggested in the figures to provide means for aligning and locking legs 22, 24 upon movement of legs 22, 24 to the side-by-side collapsed position shown best in FIGS. 3–5. Carrier lock 30 also provides handle means for carrying the collapsed ladder 10. Carrier lock 30 includes a pivot support mount 50 coupled to front right leg 22 using a fastener 52 as shown in FIGS. 6–8 and handle 32 mounted to pivot support mount 50 for pivotable movement relative to pivot support mount 50. Carrier lock 30 further includes an alignment bracket 54 coupled to rear right leg 24 and adopted to mate with pivot support mount 50 upon movement of front and right rear legs 22, 24 to the side-by-side collapsed position.

Figure 2A:
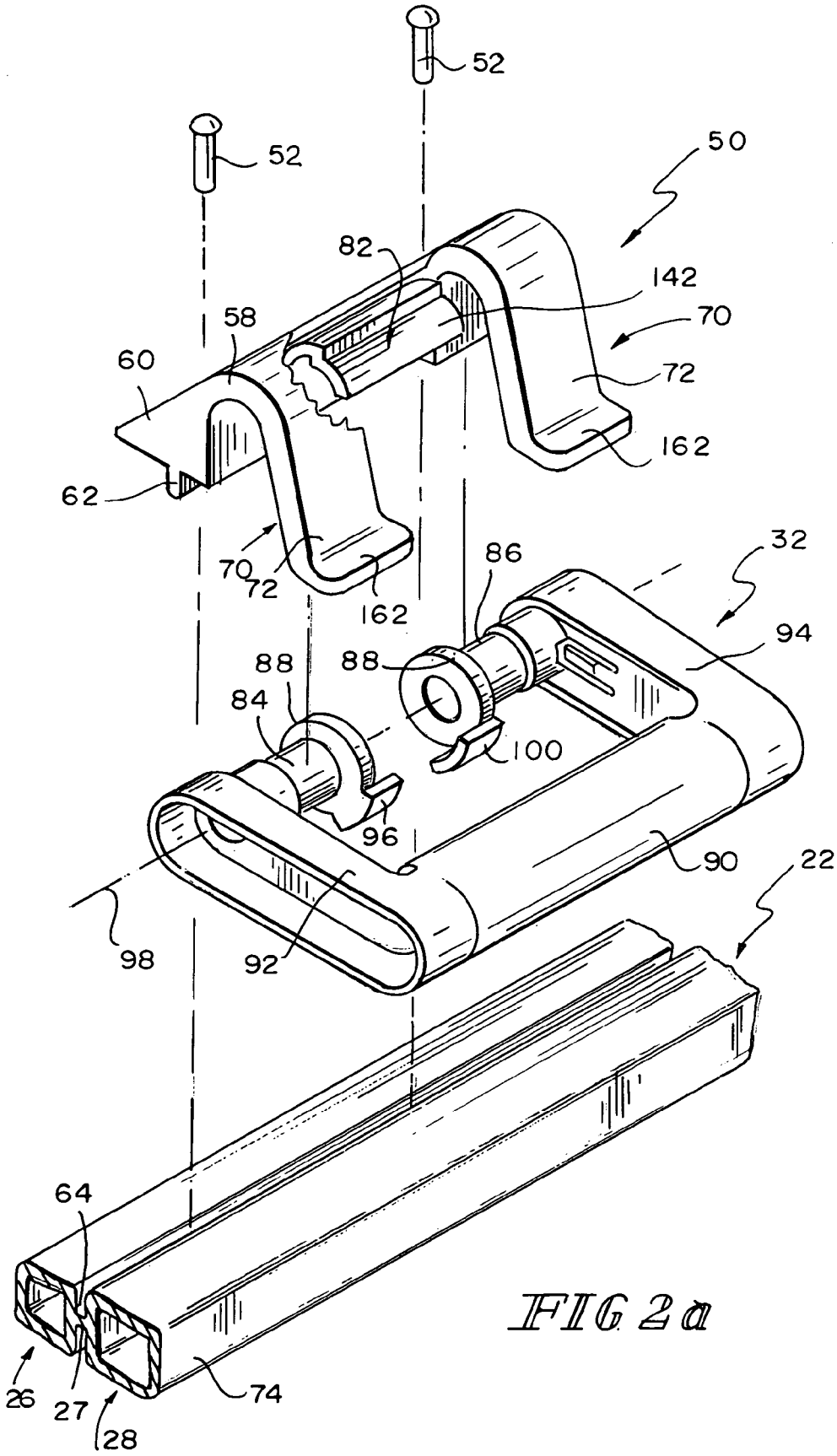
FIG. 2*a* is an exploded perspective view of the carrying handle and pivot support mount of the carrier lock showing the retainer members of the carrying handle.
Figure 2:
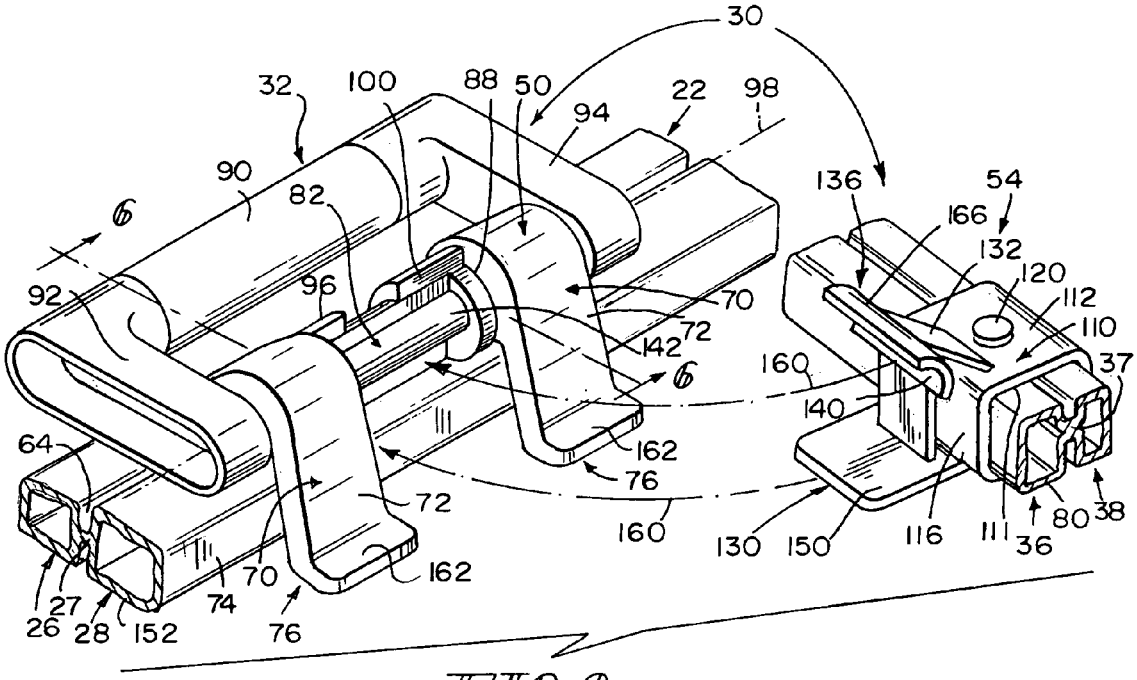
FIG. 2 is a perspective view of the carrier lock of the present disclosure showing the pivot support mount spaced-apart from the alignment bracket and including two spaced-apart alignment arms for engagement with the leg of the rear frame adjacent the alignment bracket, the handle including retainer members for pivoting movement relative to the pivot support mount, and further showing the alignment bracket including an alignment tab to engage the front right leg of the step ladder and a curved anchor member to engage the pivot support mount.

As shown in FIGS. 6–8 pivot support mount 50 of carrier lock 30 includes a base 56 having a first base portion 58 arranged to abut second tubular member 28 of front right leg 22 and a second base portion 60 arranged to abut first tubular member 26 of front right leg 22. Base 56 also includes a mount anchor 62 positioned to lie between first and second base portions 58, 60 and positioned to extend into an anchor-receiving channel 64 defined by the companion first and second tubular members 26, 28 and the web 27 located between the companion first and second tubular members 26, 28 as suggested in FIG. 6. Mount anchor 62 of base 56 is formed to include a fastener-receiving passageway 66 which is aligned with a fastener-receiving aperture 68 formed in web 27 so that fastener 52 can pass therethrough and anchor base 56 in a fixed position relative to front right leg 22. #Pivot support mount 50 further includes two spaced-apart alignment guides 70, as shown in FIGS. 2 and 2*a*, coupled to base 56. Illustratively, each alignment guide 70 is coupled to first base portion 58. Alignment guides 70 aide in aligning front and rear legs 22, 24 with each other as the legs 22, 24 are moved toward the collapsed or stowed position. Each illustrative alignment guide 70 includes a substantially vertical portion 72 coupled to base 56 and positioned to lie adjacent a side wall 74 of second tubular member 28 of first leg 22, as shown in FIGS. 2 and 6. A foot 76 is coupled to each vertical portion 72 to extend in a direction substantially perpendicular to vertical portion 72 away from first leg 22. As seen in, for example, FIG. 6 foot 76 and perpendicular vertical portion 72 generally comprise an L-shape. As is discussed in greater detail below, foot 76 of each guide 70 is positioned to lie adjacent a bottom wall 80 of first tubular portion 36 of rear leg 24 in the collapsed position in order to align rear leg 24 with front leg 22 as front let 22 and rear leg 24 are moved toward the collapsed position.

Pivot support mount 50 further includes a central pivot mount 82 coupled to base 56 and positioned between each alignment guide 70, as shown in FIGS. 2 and 2*a*, for example. A space 48 is provided between central pivot mount 82 and each a alignment guide 70, as shown in FIG. 2*a*. As is discussed below, a position of carrying handle 32 is received within each space 48. Central pivot mount 82 has a curved outer surface 142 as discussed in more detail below. Although central pivot mount 82 is provided, it is within the scope of the disclosure to include a shaft coupled to and positioned to extend between alignment guides 70 as well. As is discussed in greater detail below, a portion of alignment bracket 54 engages the curved surface 142 of shaft 82 when the first and second legs 22, 24 of step ladder 10 are adjacent each other in the collapsed position.

As mentioned above, handle 32 is coupled to pivot support mount 50 and able to pivot relative to pivot support mount 50 about a pivot axis 98. Handle 32 includes a central grip portion 90, a first arm 92 coupled to grip portion 90, and a second arm 94 coupled to grip portion 90 and spaced-apart from first arm 92. A first retainer member 96 of handle 32 is coupled to arm 92 to move with arm 92 about pivot axis 98 along shaft 82, as shown in FIG. 2. Similarly, a second retainer member 100 of handle 32 is coupled to arm 94 to move with arm 94 about pivot axis 98.

Specifically, the first retainer member 96 is coupled to a first extension member 84 which is coupled to first arm 92. Illustratively, a portion of first extension member 84 is positioned beneath first base portion 58 and a first one of the alignment guides 70. Similarly, second retainer member 100 is coupled to a second extension member 86 which is coupled to second arm 94. A portion of second extension member 86 is positioned beneath a second one of the alignment guides 70. Extension members 84, 86 thus position first and second retainer members 96, 100 spaced apart from each respective arm 92, 94 and between the first and second alignment guides 70. Illustratively, a circular flange 88 is coupled to each extension member 84, 86. Each flange 88 is received within space 48 of pivot support mount 50 between central pivot mount 82 and each alignment guide 70 when carrier handle 32 is coupled to pivot support mount 50. First retainer member 96 is coupled to first one of the flanges 88 while second retainer member 100 is coupled to a second one of the flanges 88, as shown in FIG. 2*a*, for example. Flanges 88 position each respective retainer member 96, 100 substantially above and spaced-apart from central pivot mount 82.

As is discussed in greater detail below, handle 32 pivots relative to pivot support mount 50 between locked and unlocked positions. Specifically, handle 32 is movable between and unlocked position shown in FIGS. 3 and 7, a locked and ready-to-carry position, as shown in FIGS. 4 and 8, and a locked and stowed position, as shown in FIG. 5.

First and second retainer members 96, 100 move with handle 32 as handle 32 is pivoted between these positions to engage and lock a portion of alignment bracket 54 to pivot support mount 50 when handle 32 is in either of the two locked positions, as shown in both FIGS. 4 and 5.

Looking now to FIG. 2, alignment bracket 54 includes a base 110 formed to define an aperture 111 for receiving rear leg 24 therethrough. Illustrative base 110 includes a top wall 112, a bottom wall 114 spaced-apart from top wall 112, and opposite side walls 116, 118 coupled to and positioned to extend between top and bottom walls 112, 114. Alignment bracket 54 is coupled to rear leg 24 by a fastener 120, similar to fastener 52, which extends through an aperture 124 formed in top wall 112 and an aperture 126 formed through web 37 between third and fourth tubular members 36, 38 of rear leg 24 as suggested in FIG. 6. Similar to fastener 52, fastener 120 extends into an anchor-receiving channel 122 defined by the companion third and fourth tubular members 36, 38 and the web 37 located between the companion third and fourth tubular members 36, 38 as shown in FIGS. 6–8. Fastener 120 extends through aperture 124 and aperture 126 to anchor alignment bracket 54 in a fixed position relative to rear right leg 24.

Alignment bracket 54 further includes an alignment portion 130 coupled to base 110. As is discussed in greater detail below, alignment portion 130 engages pivot support mount 50 as well as front right leg 22 to align front right leg 22 and rear right leg 24 with each other as front and rear legs 22, 24 are moved to a position adjacent each other in the collapsed position. Alignment portion 130 includes a flange 132 coupled at a first end 134 to top wall 112 of base 110. A mount-engaging member or anchor mount 136 is coupled to a second end 138 of flange 132. Illustratively, mount 136 is curved to define an inner curved surface 140 formed to engage outer curved surface 142 of central pivot mount shaft 82 of pivot support mount 50, as shown in FIG. 6.

Alignment portion 130 of alignment bracket 54 further includes an alignment tab 150 coupled to base 110. Illustratively, alignment tab 150 is coupled to both bottom wall 114 and first side wall 116 of base 110 and lies substantially in alignment with bottom wall 114, as shown in FIGS. 6–8. As is discussed in more detail below, alignment tab 150 is provided to engage a bottom wall 152 of second tubular member 28, front right leg 22 when the step ladder 10 is in the collapsed position, as shown in FIGS. 7 and 8.

As mentioned above, step ladder 10 is movable between an opened use position, shown in FIG. 1, and a stowed or collapsed position shown, with portions broken away, in FIGS. 3–5, 7, and 8. In the opened use position, front frame portion 13 (including front left and front right legs 21, 22) is spaced apart from rear frame portion 15 (including rear left and rear right legs 24, 23). In the collapsed position, front left leg 21 and rear left leg 23 are adjacent each other (not shown) and front right leg 22 and rear right leg 24 are adjacent each other, as shown in FIGS. 3–5, 7, and 8.

Carrier lock 30 is provided to align and lock front leg set or frame portion 13 with rear leg set or frame portion 15 when step ladder 10 is in the collapsed position. Handle 32 of carrier lock is provided to allow a user to conveniently carry the collapsed step ladder 10 when transporting the step ladder 10 from one location to another, for example. Alignment guides 70 of pivot support mount 50 and alignment tab 150 of alignment bracket 54 act as aligners or alignment means and cooperate with each other to align front leg 22 with rear leg 24 as ladder 10 is moved toward the collapsed position. In other words, the aligners cooperate to position the front and rear legs 22, 24 in registry with each other in the collapsed position. Illustratively, one of the alignment guides 70 of pivot support mount 50 may act as a first aligner coupled to the front leg 22 while alignment tab 150 of alignment bracket 54 may act as a second aligner coupled to rear leg 24. Further illustratively, the other alignment guide 70 of pivot support mount 50 may act as a third aligner also coupled to front leg 22. Although alignment guides 70 and alignment tabs 150 are provided, it is within the scope of this disclosure to include a carrier lock having other suitable leg alignment means.

In operation, the user moves the front leg set 13 and the rear leg 15 together from the opened position to the collapsed position. As front right leg 22 and rear right leg 24 are moved toward each other (as shown by arrows 160 in FIG. 2), alignment bracket 54 and pivot support mount 50 are moved into engagement with each other, as shown in FIGS. 2 and 6. Specifically, alignment portion 130 of alignment bracket 54 is moved to a position between the spaced-apart alignment guides 70 of pivot support mount 50, as shown in FIGS. 2 and 3.

As alignment bracket 54 is moved to the position between the alignment tabs 70 of pivot support mount 50, alignment tab 150 of alignment bracket 54 is urged to slide under front right leg 22 to lie adjacent to and generally engage bottom wall 152 of second tubular member 28, as shown in FIGS. 7 and 8. Similarly, alignment guides 70 of pivot support mount 50 are urged to slide under rear right leg 24 so that a top surface 162 of each foot 76 lies adjacent to and generally engages a bottom wall 114 of alignment bracket 54.

As mentioned above, inner curved surface 140 of mount-engaging member or anchor mount 136 of alignment bracket 54 is moved into engagement with outer surface 142 of central pivot mount 82 of pivot support mount 50. Member 136 defines a substantially concave inner surface 140 while mount 82 defines a substantially convex outer surface 142. However, it is within the scope of this disclosure to include a carrier lock having a portion of an alignment bracket having any suitable shape for cooperation with a corresponding portion of a pivot support mount having a complementary shape.

Looking now to FIG. 7, step ladder 10 is in the collapsed position. Pivot support mount 50 and alignment bracket 54 are engaged with each other in an unlocked position. As mentioned above, handle 32 is movable between the unlocked position shown in FIG. 7, the ready-to-carry and locked position shown in FIG. 8 and the stowed locked position shown in FIG. 5. In the two locked positions, the handle 32 retains the alignment bracket 54 and pivot support mount 50 in engagement with each other to lock the pivot support mount 50 and the alignment bracket 54 to each other. As shown in FIGS. 3 and 7, front and rear frame portions 13, 15 of step ladder 10 are in the collapsed and engaged, but unlocked, positions. Handle 32 is also in an unlocked position and is positioned to lie substantially adjacent to pivot support mount 50. Retainers 100 of handle 32 are in a retracted position and do not substantially engage mount 136 of alignment bracket 54.

As handle 32 is pivoted about pivot axis 98 in a clockwise direction 162, as shown in FIGS. 4 and 8, retainer members 100 move with arms 92, 94 of handle 32 about pivot axis 98 to engage member or mount 136 of alignment bracket 54. Specifically, an inner concave surface 164 of each retainer member 98, 100 engages an outer convex surface 166 of outer ends of member 36, as shown in FIGS. 4 and 8 to retain member 136 between the central pivot mount 82 and retainer members 96, 100. Flange 132 of alignment bracket 54 is positioned to lie between retainer members 100. As shown in FIGS. 4 and 8, handle 32 is in an upright or vertical position with respect to front and rear right legs 22, 24 when handle 32 is in the ready-to-carry and locked position. This upright or vertical position illustrates a lock and carry position of handle 32. As discussed above, handle 32 is provided to lock pivot support mount 50 with alignment bracket 54 to lock front and rear frame members 13, 15 to each other as well as to provide a means for a user to conveniently carry step ladder 10 when step ladder 10 is in the locked position.

Handle 32 is also movable to the locked and stowed position, as shown in FIG. 5 by further pivoting handle 32 about axis 98 in the clockwise direction beyond the vertical locked and carry position. In the locked and stowed position, handle 32 is positioned to lie substantially adjacent to right rear leg 24. In this position, retainers 100 of handle 32 maintain locking engagement with member 136 while handle 32 lies substantially flat against rear right leg 24 for storage of ladder 10.

The invention claimed is:

1. A step ladder comprising a frame including a front leg, a rear leg coupled to the front leg for pivotable movement relative to the front leg between an opened position and a collapsed position, and an alignment bracket coupled to the rear leg, a handle, a pivot support mount configured to support the handle for pivotable movement on the front leg about a pivot axis, a retainer member coupled to the handle to move therewith about the pivot axis and arranged to trap a portion of the alignment bracket coupled to the rear leg between the pivot support mount and the retainer member upon movement of the handle to a predetermined position relative to the rear leg to lock the front leg to the rear leg when the front and rear legs are in the collapsed position, and an L-shaped alignment guide immovably coupled to the front leg and configured to engage the alignment bracket coupled to the rear leg to maintain the rear leg in alignment with the front leg when the rear leg is in the collapsed position.

2. A step ladder comprising a frame including a front leg and a rear leg coupled to the front leg for movement relative to the front leg between an opened position and a collapsed position, a handle, a pivot support mount configured to support the handle for pivotable movement on the front leg about a pivot axis, a retainer member coupled to the handle to move therewith about the pivot axis and arranged to trap a portion of an alignment bracket coupled to the rear leg between the pivot support mount and the retainer member upon movement of the handle to a predetermined position relative to the rear leg to lock the front leg to the rear leg when the front and rear legs are in the collapsed position, an alignment tab maintained in a fixed position relative to the rear leg and configured to engage a bottom surface of the front leg when the frame is in the collapsed position, and an alignment guide coupled to the pivot support mount and configured to mate with the alignment tab to maintain the rear leg in alignment with the front leg when the frame is in the collapsed position.

3. The step ladder of claim 2, further comprising an anchor mount coupled to the alignment tab and configured to engage a portion of the pivot support mount when the frame is in the collapsed position.

4. The step ladder of claim 2, wherein the alignment guide of the pivot support mount is a first alignment guide and the pivot support mount includes a second alignment guide spaced-apart from the first alignment guide, and wherein the alignment tab is positioned to lie between the first and second alignment guides of the pivot support mount when the rear leg is in the collapsed position.

5. The step ladder of claim 2, further comprising an alignment bracket coupled to the rear leg and formed to include the alignment tab, the alignment bracket including a base having a top wall, a bottom wall, a first side wall coupled to the top wall and the bottom wall, and a second side wall coupled to the top wall, and wherein the bottom wall, the top, bottom, first, and second side walls are formed to define an aperture configured to receive the rear leg therethrough and wherein the alignment tab is coupled to the base and is substantially in alignment with the bottom wall of the base.

* * * * *